US005358584A

United States Patent [19]

Bendersky

[11] Patent Number: 5,358,584

[45] Date of Patent: Oct. 25, 1994

[54] HIGH INTERMETALLIC TI-AL-V-CR ALLOYS COMBINING HIGH TEMPERATURE STRENGTH WITH EXCELLENT ROOM TEMPERATURE DUCTILITY

[75] Inventor: Leonid A. Bendersky, Gaithersburg, Md.

[73] Assignee: The United States of America as represented by the Secretary of Commerce, Washington, D.C.

[21] Appl. No.: 93,645

[22] Filed: Jul. 20, 1993

[51] Int. Cl.[5] ..... C22C 14/00

[52] U.S. Cl. ..... 148/421; 148/671; 420/418; 420/421

[58] Field of Search ..... 148/421, 671; 420/418, 420/421

[56] References Cited

U.S. PATENT DOCUMENTS

| | | | |
|---|---|---|---|
| 4,292,077 | 9/1981 | Blackburn et al. | 148/11.5 F |
| 4,716,020 | 12/1987 | Blackburn et al. | 420/418 |
| 4,788,035 | 11/1988 | Gigliotti, Jr. et al. | 420/420 |
| 4,891,184 | 1/1990 | Mikkola | 420/553 |
| 4,919,886 | 4/1990 | Venkataraman et al. | 420/420 |
| 4,983,357 | 1/1991 | Mitao et al. | 420/418 |
| 5,006,054 | 4/1991 | Nikkola | 420/552 |
| 5,032,357 | 7/1991 | Rowe | 420/418 |
| 5,183,635 | 2/1993 | Kerry et al. | 148/421 |
| 5,185,045 | 2/1993 | Peters et al. | 148/671 |

*Primary Examiner*—Upendra Roy
*Attorney, Agent, or Firm*—Thomas P. Pavelko

[57] ABSTRACT

A Ti—Al—V—Cr intermetallic alloy having an atomic percent composition of 25–35 Al, 10–15 (V+Cr), the balance being Ti. The alloy is partially of $DO_{19}$ type and partially of B2 type and has high temperature strength and excellent room temperature ductility. The alloy is produced by arc melting the metallic components Ti, Al and at least one of V and Cr; followed by homogenizing the melted components; solidifying the melted components to form an alloy; hot working the solidified alloy by isothermal forming to form a beta-phase polycrystalline microstructure; transforming the metastable $\beta$-phase into a two-phase microstructure; and equilibrating the two-phase microstructure by prolonged annealing.

9 Claims, 6 Drawing Sheets

100 μm
700 °C, 3 WEEKS
456 HV10Kg

100 μm
800 °C, 2 WEEKS
422 HV10Kg

100 μm
900 °C, 5 DAYS
411 HV10Kg

100 μm
700 °C, 3 WEEKS
546 HV10Kg

100 μm
800 °C, 2 WEEKS
516 HV10Kg

100 μm
900 °C, 5 DAYS
490 HV10Kg

HIGH INTERMETALLIC TI-AL-V-CR ALLOYS COMBINING HIGH TEMPERATURE STRENGTH WITH EXCELLENT ROOM TEMPERATURE DUCTILITY

BACKGROUND OF THE INVENTION

The present invention relates to a series of Ti—Al—V—Cr intermetallic alloys having atomic percent (at %) compositions of 25–35 at % Al, 10–15 at % (V+Cr), with the balance being Ti. These low density (approximately 4.3 g/cm$^3$) alloys have an exceptionally good combination of room temperature (RT) and high-temperature (HT) mechanical properties.

FIELD OF THE INVENTION AND DESCRIPTION OF RELATED ART

At room temperature (RT) the ductility (up to 10% in compression) of the alloys of the present invention are comparable with commercial Ti alloys while the yield strength is significantly higher (1600 to 1900 MPa) as compared to 1100 MPa of the best commercial Ti alloys. See *Metals Handbook*, vol. 1, ASM, Metals Park, Ohio (1989) (the disclosure of which is hereby incorporated by reference). At high temperature (HT) (up to 750° C.) the alloys have a strength superior to other Ti aluminide-based alloys as well as to the commercial Ti alloys and superalloys. See U.S. Pat. No. 4,292,077 to Blackburn et al., U.S. Pat. No. 5,032,357 to Rowe, U.S. Pat. No. 4,983,357 to Mitao et al., the disclosures of which are hereby incorporated by reference. With such properties the alloys have great potential for a number of both high and low temperature aerospace applications, including replacement of heavier (8–9 g/cm$^3$) nickel-based superalloys in different components of a new generation of jet engines.

The properties of the alloys of the present invention can be enhanced by proper heat treatment to form a thermodynamically stable microstructure consisting of two intermetallic phases: hexagonal $\alpha_2$ and cubic B2. The two phases are structurally related, and therefore a rich variety of semi-coherent fine microstructures can be achieved by different cooling and heating schedules. The alloys can be readily processed by conventional casting and isothermal forging routes. The presence of each phase in the alloys' microstructure is designed to provide a certain property to the material: close-packed ordered $\alpha_2$ for high temperature strength and creep resistance and ordered cubic B2 for low temperature ductility and toughness.

The need for low density structural materials with high temperature strength, tolerable low temperature ductility and reasonable oxidation resistance for aerospace applications provides the reason for continuous strong interest in Ti aluminides. Two intermetallic compounds, $Ti_3Al$, or $\alpha_2$, with $DO_{19}$ structure and TiAl, or $\gamma$, with $L1_0$ structure, are utilize for those purposes in different alloys. One class of the alloys is based on microstructures composed of the binaries $Ti_3Al$ and TiAl with small additions of other elements to modify properties and phase boundaries of the phases. See U.S. Pat. No. 4,983,357 to Mitao et al.; Izumi, ed., *Papers in the Proceeding of International Symposium on Intermetallic Compounds—Structure and Mechanical Properties*, The Japan Institute of Metals (1991), the disclosures of which are hereby incorporated by reference. In the second class of the alloys, addition of Nb is used in order to increase plasticity of the $\alpha_2$ phase and form microstructures combining $\alpha_2+\beta$(BCC)/B2 phases in the Ti—Al—Nb system. See U.S. Pat. No. 4,292,077 to Blackburn et al.; Izumi, ed., *Papers in the Proceeding of International Symposium on Intermetallic Compounds—Structure and Mechanical Properties*, The Japan Institute of Metals (1991), the disclosures of which are hereby incorporated by reference. Very promising combinations of specific strength and rupture life at high temperature (below 800° C.) were achieved for alloys with compositions based on the Ti-24Al-11Nb (at %).

Other U.S. patents which show the state of the art include U.S. Pat. No. 4,820,486 to Shimogori et al.; U.S. Pat. No. 4,902,535 to Garg et al.; U.S. Pat. No. 4,910,091 to Garg et al.; U.S. Pat. No. 4,919,886 to Venkataraman et al.; and U.S. Pat. No. 4,927,713 to Garg et al.

SUMMARY OF THE INVENTION

The main purpose of the present invention is to improve low temperature ductility of the $\alpha_2$-type Ti—Al—Nb alloys without sacrificing their high temperature strength. This is achieved by replacing Nb with V and Cr. The replacement also results in lower (10 to 15%) density alloys. The inclusion of Cr in these alloys is expected to be beneficial against low temperature environmental embrittlement and/or HT oxidation. See Meier et al., *Mat. Sci. Eng.* A153, 548 (1992), the disclosure of which is hereby incorporated by reference.

DESCRIPTION OF THE DRAWINGS

FIGS. 4A, B and C show Ti-29.3Al-14.4V (at %) heat treated and tested according to the following conditions: In FIG. 4A—700° C., 3 weeks and 456 HV 10 kg; FIG. 4B—800° C., 2 weeks and 422 HV 10 kg; and FIG. 4C—900° C., 5 days and 411 HV 10 kg. FIGS. 4D, E and F show Ti-29.2Al-8.5V-6.0Cr (at %) specimens heat treated and tested according to the following conditions: FIG. 4D—700° C., 3 weeks and 546 HV 10 kg; FIG. 4E—800° C., 2 weeks and 516 HV 10 kg; and FIG. 4F—900° C., 5 days and 490 HV 10 kg.

DETAILED DESCRIPTION OF THE INVENTION

Figure 1B:
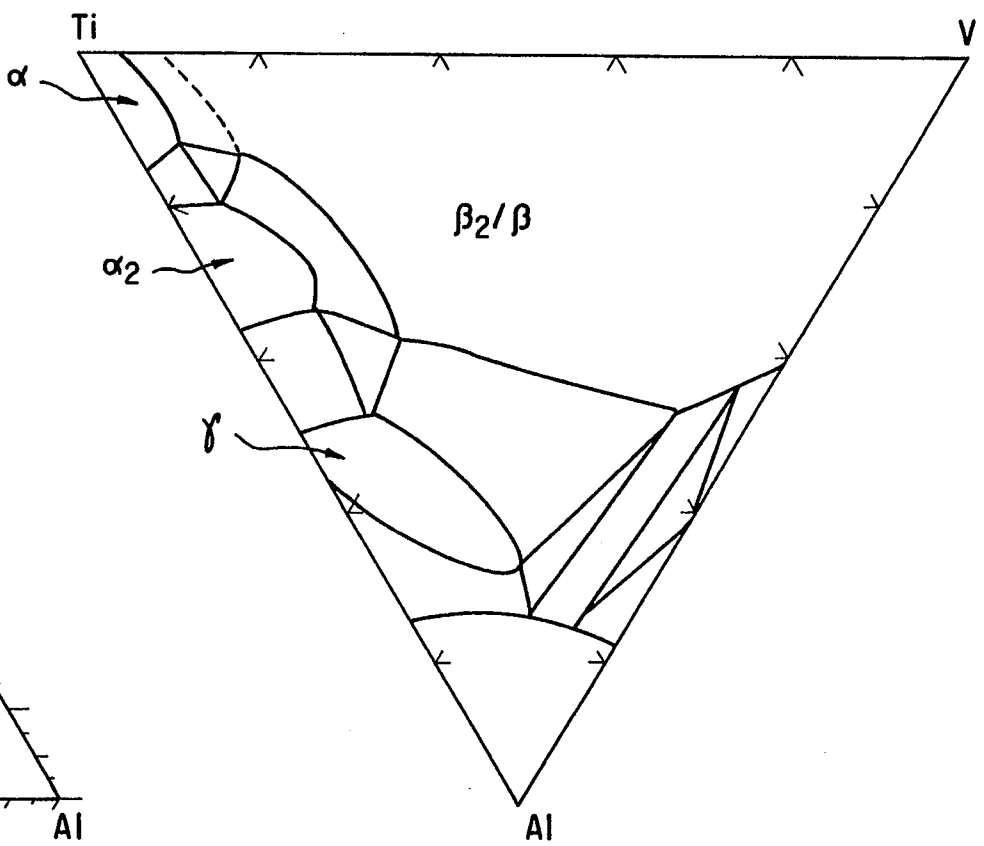
FIG. 1B is a graph of the 800° C. isothermal section of the Ti—Al—V phase diagram.
Figure 1A:
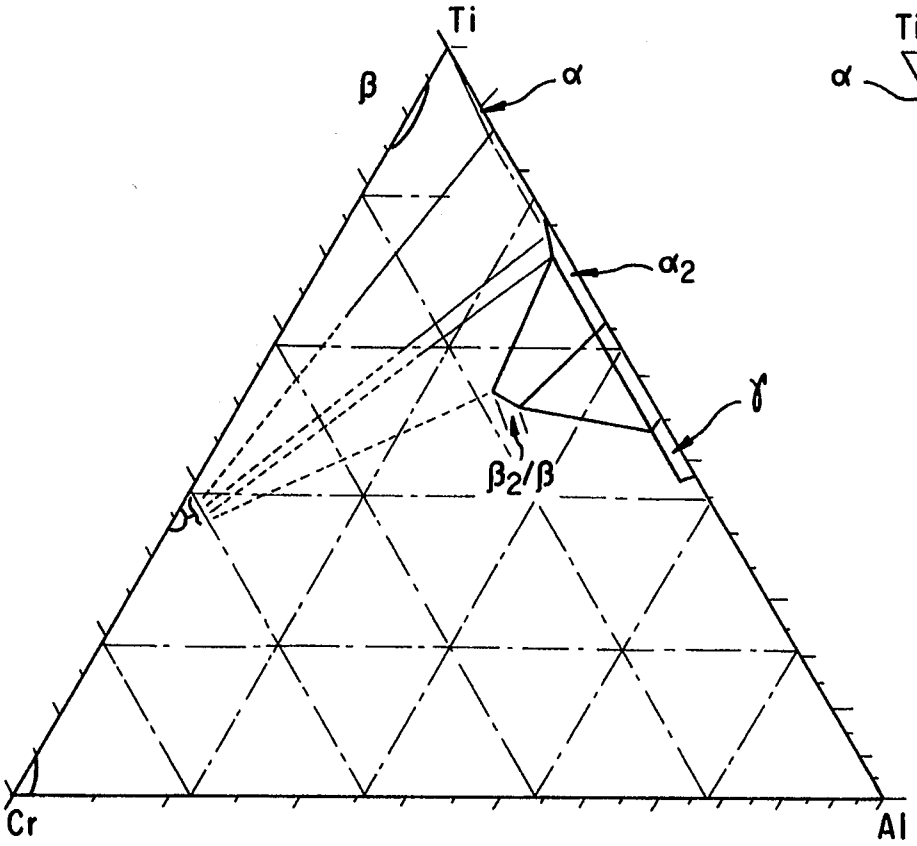
FIG. 1A is a graph of the 800° C. isothermal section of the Ti—Al—Cr phase diagram.

The composition domain of the alloys was decided according to the available ternary phase diagrams—Ti—Al—Cr [See Hayes, *J. Phase Equilibria,* 13, 79 (1992) (the disclosure of which is hereby incorporated by reference)] and Ti—Al—V [See Hashimoto et al., *Trans. Jap. Inst. Met.,* 27, 741 (1986); and Ahmed et al., *Mat. Sci. Eng.,* A152, 31 (1992), the disclosures of which are hereby incorporated by reference]. From the 800° C. isothermal sections (FIG. 1) the two phase ($\alpha_2+\beta$(BCC)/B2) alloys were decided to have the following range of compositions (at %): 55–65 Ti, 25–35 Al, 10–15 (V+Cr).

A. DESCRIPTION OF PHASES AND MICROSTRUCTURES IN TWO ALLOYS

Figure 2A:
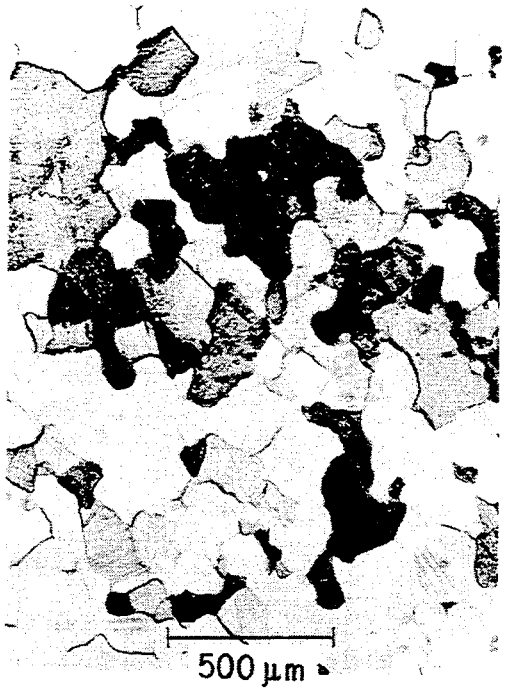
FIG. 2A shows a beta-phase polycrystalline microstructure of the Ti-29.2Al-8.5V-6.0Cr (at %) alloy isothermally forged (pressed) at 1100° C. in which the optical metallographic section is normal to the forging direction.
Figure 2B:
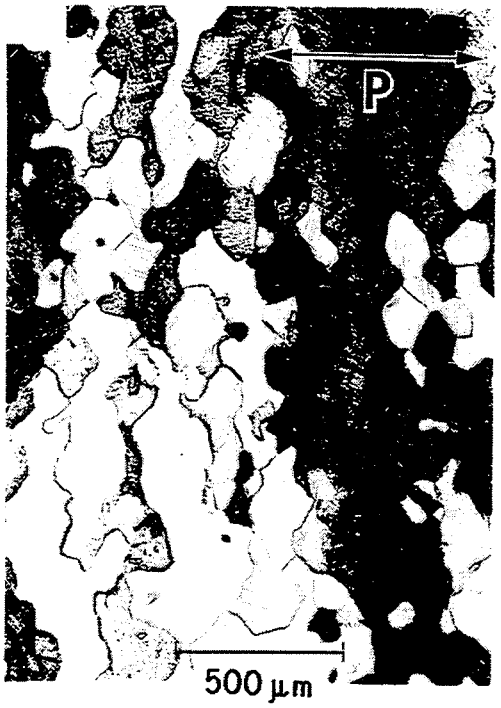
FIG. 2B shows a beta-phase polycrystalline microstructure of the Ti-29.2Al-8.5V-6.0Cr (at %) alloy isothermally forged (pressed) at 1100° C. in which the optical metallographic section is parallel to the forging direction P.

The presence of the two phases in the chosen domain of compositions, presumably in thermodynamic equilibrium with each other at temperatures below 900° C., was demonstrated for ternary, Ti-29.3Al-14.4V (at %), and quaternary, Ti-29.2Al-8.5V-6.0Cr (at %), alloys. The alloys were produced by are melting followed by homogenizing at 1300° C. for 3 hours. Near 1100° C. both of the above-mentioned alloys have a one phase ($\beta$) structure and can be readily hot worked by isothermal forging in order to form a beta-phase polycrystalline microstructure (FIG. 2).

Figure 3:
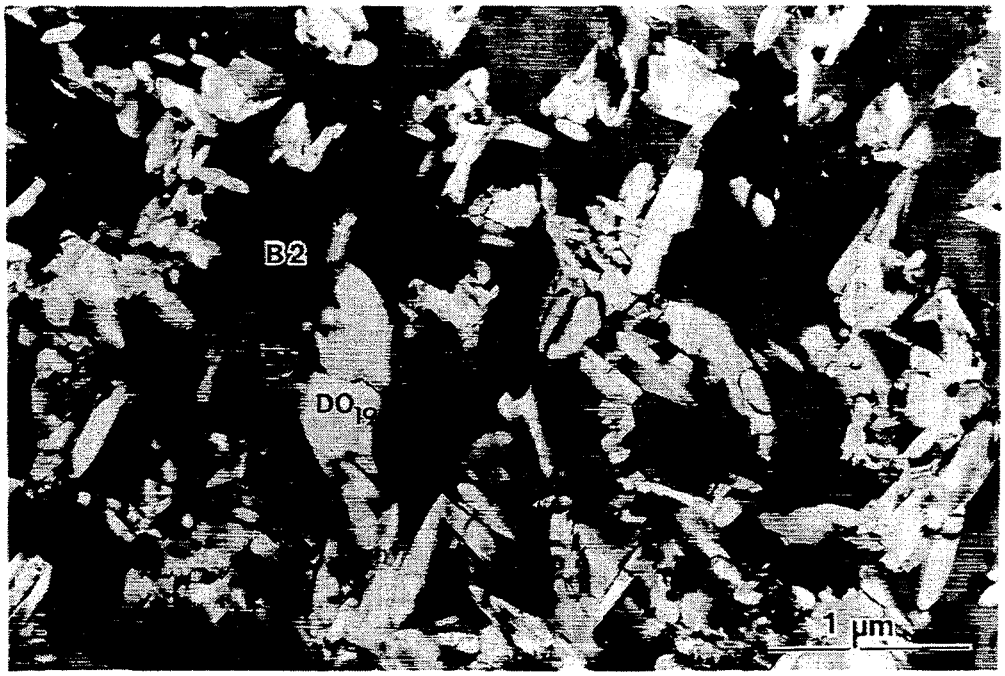
FIG. 3 shows the bright field TEM image of a microstructure of the Ti-29.2Al-8.5V-6.0Cr (at %) alloy after annealing at 700° C. for 21 days, said microstructure consisting of a homogeneous distribution of an $\alpha_2$ phase plate-like particles in a B2 phase matrix.
Figure 4A:
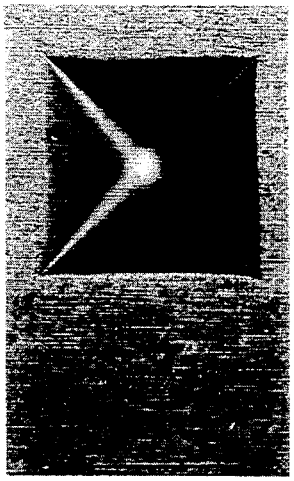
FIGS. 4A–F show the results of examination of 10 kg microhardness indentions. No cracking or coarse slip are shown for the specimen heat treated below 900° C.
Figure 4B:
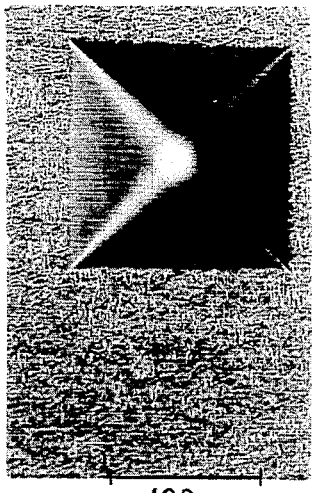
Figure 4C:
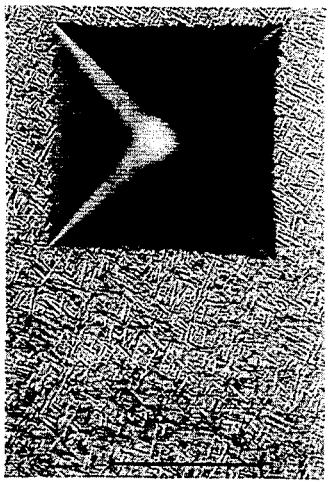
Figure 4D:
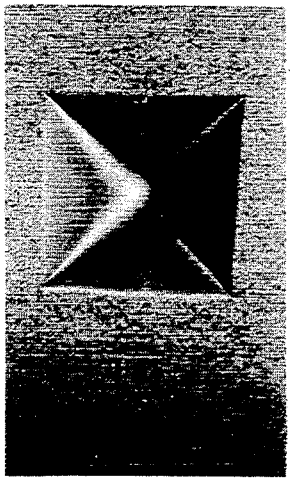
Figure 4E:
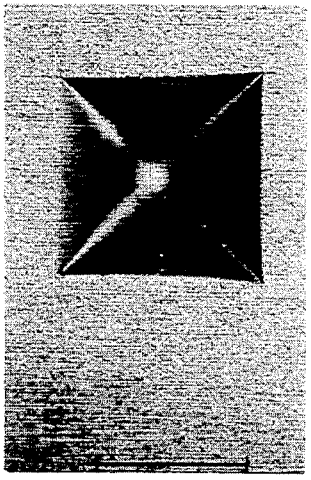
Figure 4F:
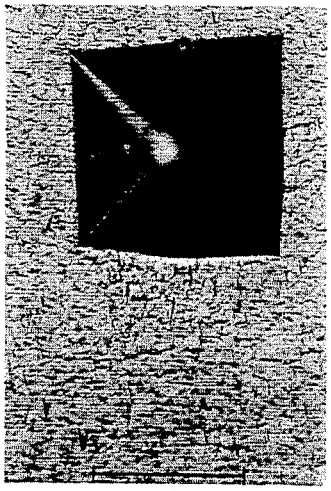

Exposure at 700°–900° C., which are temperatures of possible alloy use, transforms metastable $\beta$ phase into a two-phase structure. This two-phase microstructure, which is equilibrated by prolonged annealing, determines the properties of the alloys at temperatures up to the anneal temperature. For both alloys the microstructures consist of a homogeneous distribution of plate-like particles in a matrix. Selected area and microdiffraction proves that the plates are the hexagonal $DO_{19}$ phase while the matrix is the cubic B2. An example of the microstructure is shown in FIG. 3 for the Ti-29.2Al-8.5V-6.0Cr (at %) after annealing at 700° C. for 21 days. Lack of anti-phase boundaries due to BCC/B2 ordering suggests that the cubic phase is ordered up to 1100° C.—an important factor for maintaining high temperature strength.

B. MECHANICAL PROPERTIES

To substantiate the claim of the improved room temperature ductility and high temperature strength, room and high temperature compression tests on cylindrical specimens were made for the two alloys discussed above. 10 kg load room temperature microhardness measurements were also performed in order to see the effect of heat treatments at different temperatures. Examination of microhardness indentations shows no cracking or coarse slip for the specimen heat treated below 900° C. (FIG. 4). Lack of cracking combined with measured high strength (microhardness) suggests significant room temperature toughness and possible ductility.

Figure 5A:
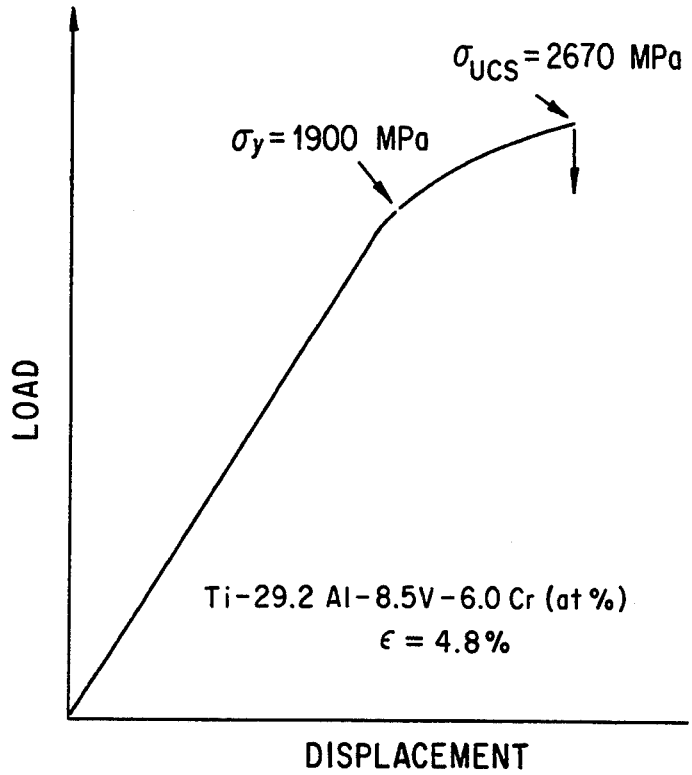
FIG. 5A is a graph of the load/displacement of a room temperature compression test for the alloy Ti-29.2Al-8.5V-6.0Cr (at %) after heat treatment as follows: 1200° C., 3 hours, water quenched +700° C., 5 days, water quenched.
Figure 5B:
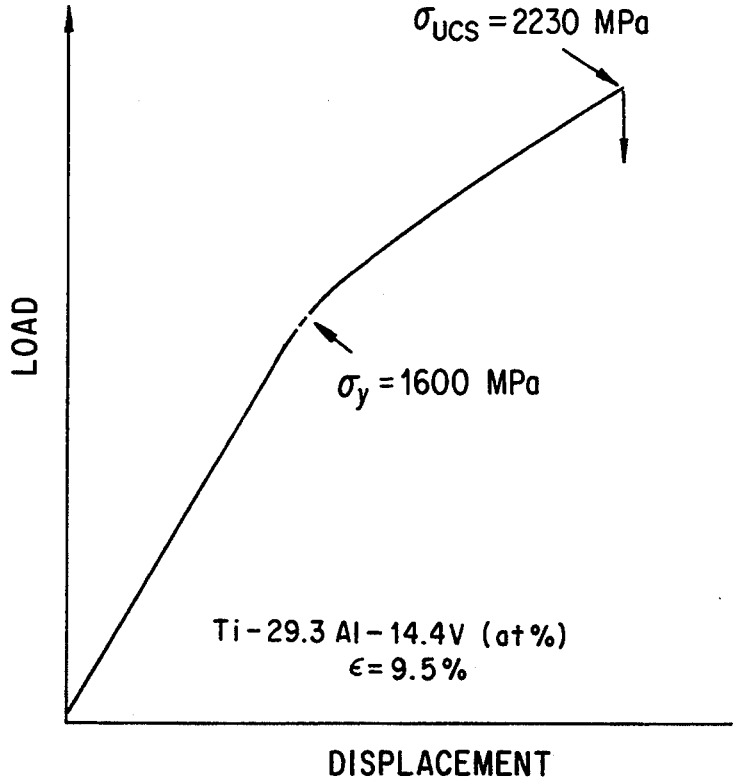
FIG. 5B is a graph of the load/displacement of the room temperature compression test for the alloy Ti-29.3Al-14.4V (at %) after heat treatment as follows: 1200° C., 3 hours, water quenched +700° C., 5 days, water quenched.

The ductility was confirmed by room temperature compression tests. FIG. 5A, 5B shows examples of load/displacement curves for the two alloys. The compression specimens machined from cast ingots had the following heat treatments: 1200° C., 3 hours, water quenching +700° C., 5 days, water quenching. The tests show 9.5% ductility for the Ti-29.3Al-14.4V (at %) alloy and 4.8% for the Ti-29.2Al-8.5V-6.0Cr (at %). This ductility is combined with remarkably high yield (y) (1600 and 1900 MPa, respectively) and ultimate compression stresses (UCS) of 2670 and 2230 MPa, respectively. The strength of the alloys is almost twice as high, for example, as one of the best commercial Ti-6Al-4V alloys of comparable ductility (1050 MPa yield strength, 1190 MPa tensile strength, 7% elongation [See *Metals Handbook*, vol. 1, ASM, Metals Park, Ohio (1989)]).

Figure 6:
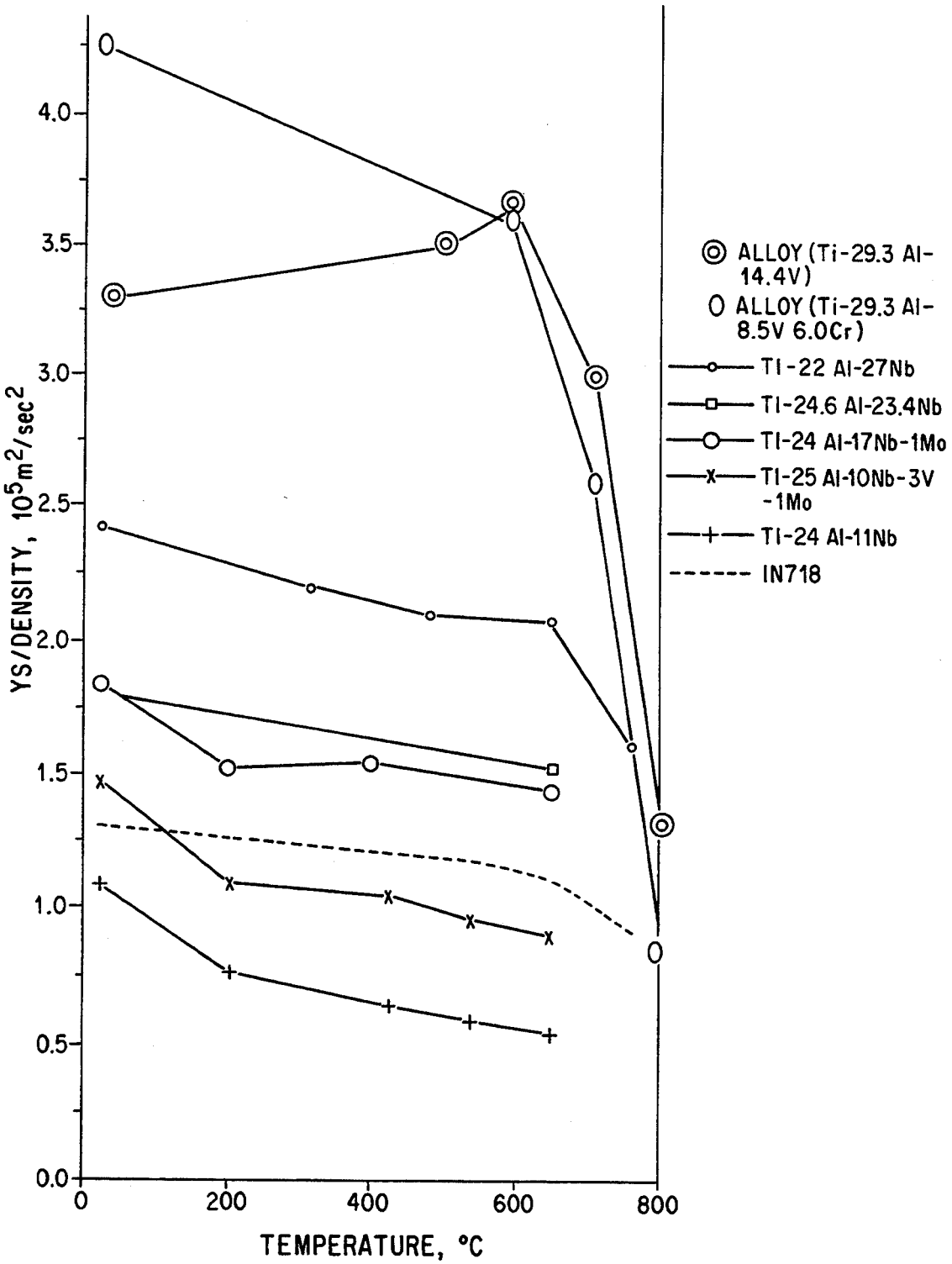
FIG. 6 is a graph of the specific 0.2% yield compression strength of the Ti-29.3Al-14.4V (at %) and Ti-29.2Al-8.5V-6.0Cr (at %) alloys as a function of compression test temperatures. The results are compared with other Ti aluminides and the commercial superalloy IN718.

High temperature yield strength was measured for both alloys by compression tests performed in a vacuum furnace at temperatures between 600° and 900° C. During the tests the same specimen was deformed at different temperatures, starting at 600° C. and increasing to 900° C. After the noticeable yield at the lower temperature test has been reached, the specimen was unloaded and temperature was increased for a new loading. Results of 0.2% yield strength normalized to the density of the alloy as a function of test temperature is shown in FIG. 6. The results are compared with the best Ti aluminides (i.e. those of U.S. Pat. No. 4,292,077 to Blackburn) and the commercial superalloy IN718. The alloys of the present invention show superior specific yield strength at temperatures up to 750° C. Considering the structural stability found for the alloys of the present invention in this temperature range, the inventors also expect good creep strength.

C. APPLICATIONS

Extremely high specific strength and microstructural stability at elevated temperatures make the alloy of the present invention a good candidate for aerospace applications. The alloy can find use in a new generation of jet turbines for such parts as disks, blades and vanes. Another application at lower temperatures can be as structural parts of an aircraft body. Moreover, the alloy applications are not necessarily limited to aerospace technology. The alloy also can be used as a matrix material for different metal-matrix composites.

From the foregoing description, one skilled in the art can easily ascertain the essential characteristics of this invention, and without departing from the spirit and scope thereof, can make various changes and modifications of the invention to adapt it to various usages and conditions.

What is claimed:

1. A Ti—Al—V—Cr intermetallic alloy having an atomic percent composition of 25–35 Al, 10–15 (V+Cr), the balance being Ti.

2. The alloy of claim 1, wherein said alloy is partially of $\alpha_2$ type and partially of B2 type.

3. The alloy of claim 1, having the atomic percent composition Ti-29.3Al-14.4V.

4. The alloy of claim 1, having the atomic percent composition Ti-29.2Al-8.5V-6.0Cr.

5. A jet turbine disk made of the alloy of claim 1.

6. A jet turbine blade made of the alloy of claim 1.

7. A jet turbine vane made of the alloy of claim 1.

8. A matrix material for different metal-matrix composites comprising the alloy of claim 1.

9. A Ti—Al—V—Cr intermetallic alloy having an atomic percent composition of 25–35 Al, 10–15 (V+Cr), the balance being Ti, said alloy being produced by the process comprising:

arc melting the metallic components Ti, Al and at least one metal selected from the group consisting of V and Cr followed by homogenizing the metal components;

solidifying the melted components to form an alloy;

hot working the solidified alloy by isothermal forming to form a beta-phase polycrystalline microstructure;

transforming said metastable $\beta$-phase into a two-phase microstructure; and equilibrating said two-phase microstructure by prolonged annealing.

* * * * *